US008390650B2

(12) United States Patent
Shen et al.

(10) Patent No.: US 8,390,650 B2
(45) Date of Patent: Mar. 5, 2013

(54) METHOD FOR DISPLAYING AND PROCESSING VIDEO DATA AND RELATED VIDEO DATA PROCESSING APPARATUS

(75) Inventors: Yun-Hung Shen, Hsin-Chu (TW); Her-Ming Jong, Hsinchu (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 1508 days.

(21) Appl. No.: 11/737,148

(22) Filed: Apr. 19, 2007

(65) Prior Publication Data

US 2008/0111778 A1 May 15, 2008

(30) Foreign Application Priority Data

Nov. 14, 2006 (TW) ..... 95142054 A

(51) Int. Cl.
*G09G 5/10* (2006.01)

(52) U.S. Cl. ..... 345/690; 375/240.16; 345/60; 345/76; 345/82; 345/84

(58) Field of Classification Search ..... 345/60–72, 345/76–104, 204, 690–697; 375/240.12, 375/240.16
See application file for complete search history.

(56) References Cited

U.S. PATENT DOCUMENTS

| | | | | |
|---|---|---|---|---|
| 6,008,865 | A | 12/1999 | Fogel | |
| 2002/0044115 | A1 | 4/2002 | Jinda | |
| 2003/0058264 | A1 | 3/2003 | Takako | |
| 2005/0140626 | A1 * | 6/2005 | Doyen et al. | 345/89 |

FOREIGN PATENT DOCUMENTS

| | | |
|---|---|---|
| CN | 1577471 A | 2/2005 |
| CN | 1661429 A | 8/2005 |
| TW | 548616 | 8/2003 |

OTHER PUBLICATIONS

Ono, K, et al., "69.5: Invited Paper: Progress of IPS-PRO Technology for LCD-TVS," SID Digest '06 SID: International Symposium Digest of Technical Papers, Jun. 6, 2006, vol. 37, pp. 1954-1957.*

Tsutomu Furuhashi, et al., "48.3: Invited Paper: High Quality TFT-LCD System for Moving Picture", pp. 1284-1287, SID Digest 2002.

Jun-Ichi Hirakata, et al., "35.2: Super-TFT-LCD for Moving Picture Images with the Blink Backlight System", pp. 990-993, SID Digest 2001.

Katsuhiko Kumagawa, et al., "48.4: Invited Paper: Fast Response OCB-LCD for TV Applications", pp. 1288-1291, SID Digest 2002.

T. Nose, et al., "35.3: A Black Stripe Driving Scheme for Displaying Motion Pictures on LCDs", pp. 994-997, SID Digest 2001.

N. Fisekovic, et al., "Improved Motion-Picture Quality of AM-LCDs Using Scanning Backlight", pp. 1637-1640, Asia Display/IDW 2001.

* cited by examiner

*Primary Examiner* — Michael Pervan
(74) *Attorney, Agent, or Firm* — Winston Hsu; Scott Margo

(57) ABSTRACT

The present invention discloses a method for displaying video data. The method includes: generating an intermediate image between a first and a second image of the video data, wherein the first image is adjacent to the second image in the video data; adjusting a plurality of intermediate pixels of the intermediate image to generate a luminance-adjusted image; and displaying the first image, the luminance-adjusted image, and the second image in turn.

16 Claims, 3 Drawing Sheets

METHOD FOR DISPLAYING AND PROCESSING VIDEO DATA AND RELATED VIDEO DATA PROCESSING APPARATUS

BACKGROUND OF THE INVENTION

1. Field of the Invention

The invention relates to display of video data, and more particularly, to a method for displaying and processing video data and related video data processing apparatus.

2. Description of the Prior Art

Liquid crystal display (LCD) is one of the major display devices available on the current market. The LCD can be applied in a notebook, PC, or TV, etc. Compared with a cathode ray tube (CRT) that belongs to an impulse type display device, the LCD belongs to a hold type display device. The CRT that belongs to impulse type display devices is suitable for displaying dynamic images, and the LCD that belongs to the hold type display device is suitable for displaying static images.

Since the LCD belongs to the hold type display device, when using the LCD to display dynamic images, problems of blurred images occur. The LCD industry is therefore devoted to improving display capability and quality of the LCD when displaying dynamic images. For example, over-driving, dynamic contrast compensation (DCC), scan backlight systems, blinking backlight systems, and black image insertion are several conventional related techniques for improving display capability and quality of the LCD when displaying dynamic images. However, although the conventional techniques mentioned above can improve display capability and quality of the LCD when displaying dynamic images, the conventional techniques cannot solve the problem of blurred images completely. Therefore, these conventional techniques do not provide the best solution.

SUMMARY OF THE INVENTION

It is therefore one of the objectives of the present invention to provide a method for displaying and processing video data and related video data processing apparatus being capable of solving the problem of blurred images.

According to an embodiment of the present invention, a method for displaying video data is disclosed. The method includes: generating an intermediate image between a first and a second image of the video data, wherein the first image is adjacent to the second image in the video data; adjusting luminance of the intermediate image to generate a luminance-adjusted image; and displaying the first image, the luminance-adjusted image, and the second image in turn.

According to an embodiment of the present invention, a video data processing apparatus is further disclosed. The video data processing apparatus includes: an intermediate image generating module, for generating an intermediate image between a first and a second image of the video data, wherein the first image is adjacent to the second image in the video data; a luminance adjusting module, coupled to the intermediate image generating module, for adjusting luminance of the intermediate image to generate a luminance-adjusted image; and a display driving module, coupled to the luminance adjusting module, for driving a display device in order to display the first image, the luminance-adjusted image, and the second image in turn.

According to an embodiment of the present invention, a motion image data processing method is further disclosed. The motion image data processing method includes: receiving a motion image data signal; generating an intermediate image according to two adjacent images in the motion image data signal; adjusting luminance of each pixel of the intermediate image to generate a luminance-adjusted image and to set whole luminance of the luminance-adjusted image lower than the adjacent images; and inserting the luminance-adjusted image between the adjacent images in the motion image data signal to generate an output video data signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
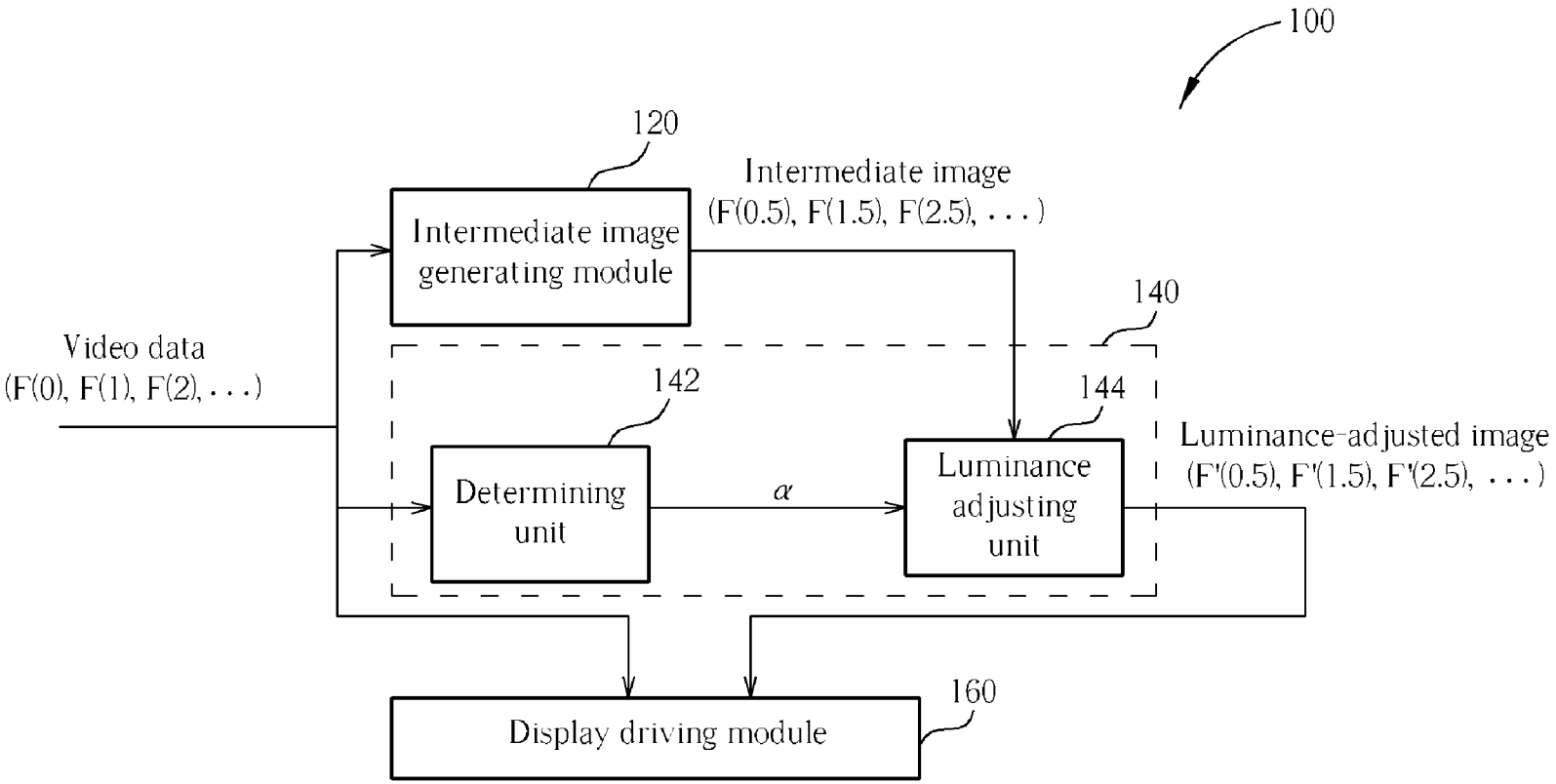
FIG. 1 is a block diagram of a video data processing apparatus according to an embodiment of the present invention.

Please refer to FIG. 1. FIG. 1 is a block diagram of a video data processing apparatus according to an embodiment of the present invention. In this embodiment, the video data processing apparatus 100 includes an intermediate image generating module 120, a luminance adjusting module 140, and a display driving module 160. In order to enable a display device to have better display quality when displaying video data (especially when displaying motion image data), the intermediate image generating module 120 generates an intermediate image between every two adjacent images in the video data additionally. For each intermediate image, the luminance adjusting module 140 adaptively adjusts the luminance of the intermediate image in order to generate a luminance-adjusted image. The display driving module 160 is utilized for driving the display device in order to display the images in the video data and the luminance-adjusted image generated by the luminance adjusting module 140 alternately.

Figure 2:
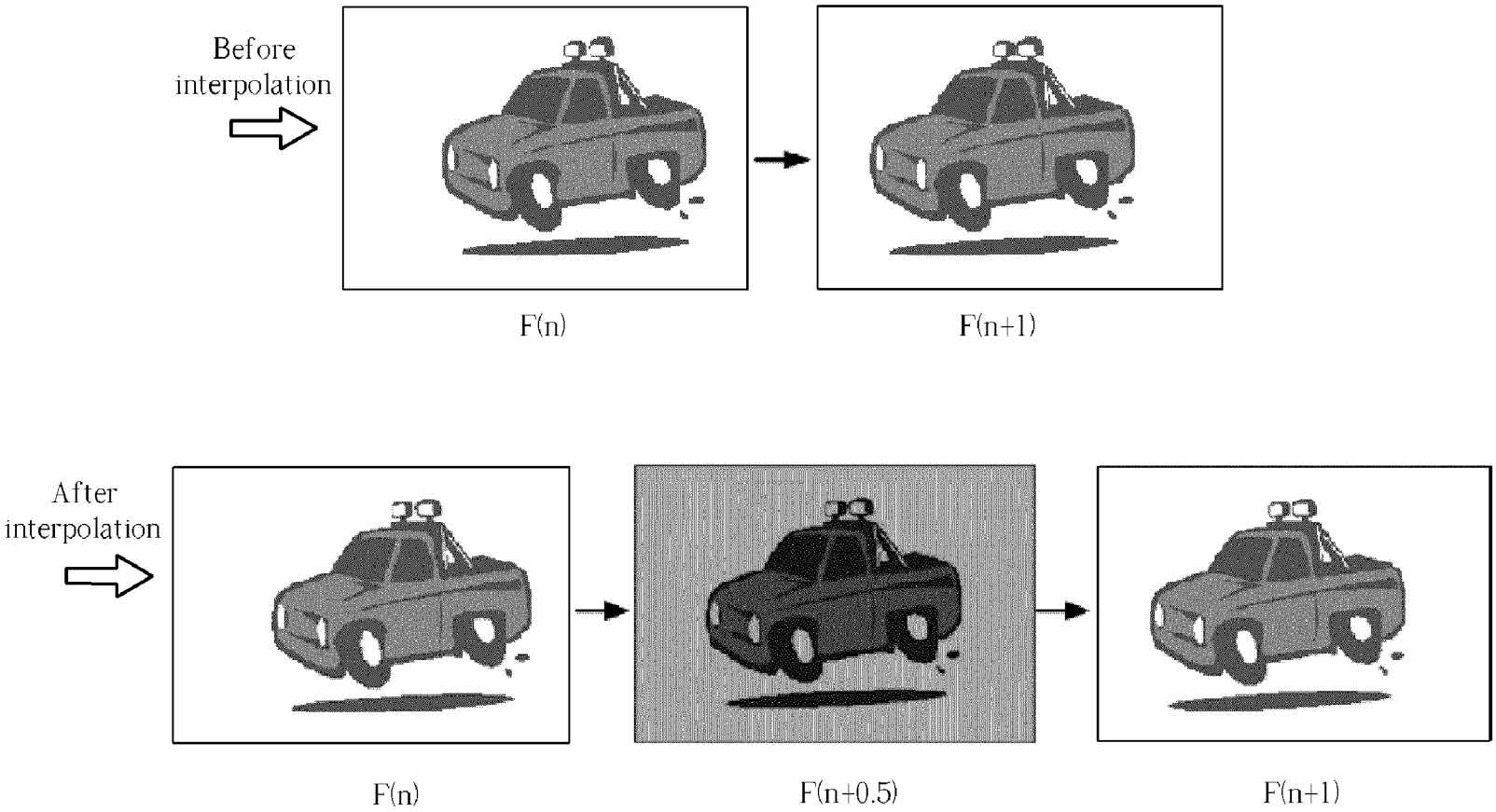
FIG. 2 is a diagram for illustrating before and after the luminance-adjusted image is inserted in the video data.

For example, the images in the video data, the additionally generated intermediate image, and the luminance-adjusted image mentioned can all be complete frames, and the intermediate image generating module 120 can be a motion compensated interpolation module. Between a first image F(n) and a second image F(n+1) (n can be any integer) that are adjacent to each other in the video data, the intermediate image generating module 120 can generate an intermediate image F(n+0.5) via the motion compensated interpolation. The luminance adjusting module 140 can adaptively lower the luminance of a plurality of intermediate pixels of the intermediate image F(n+0.5) to generate a luminance-adjusted image F'(n+0.5), and therefore the luminance of the luminance-adjusted image will be lower than the first image or the second image. Please refer to FIG. 2. FIG. 2 is a diagram for illustrating before and after the luminance-adjusted image is inserted in the video data. The display driving module 160 drives the display device in order to display the images F(0), F(0.5), F(1), F(1.5), . . . , F(n), F(n+0.5), F(n+1), . . . , and the image outputting frequency of the video data processing apparatus 100 is twice as fast as the frame rate of the video data under the circumstances.

The luminance adjusting module 140 of this embodiment includes a determining unit 142 and a luminance adjusting unit 144; wherein, for an intermediate pixel IP of the intermediate image F(n+0.5), the determining unit 142 determines a luminance-adjusted factor $\alpha$ according to a motion vector MV defined by a first pixel P1 and a second pixel P2. The first pixel belongs to the first image F(n) and corresponds to the intermediate pixel IP of the intermediate image F(n+0.5). The second pixel belongs to the second image F(n+1) and corresponds to the intermediate pixel IP of the intermediate image F(n+0.5). In general, the luminance-adjusted factor $\alpha$ is between 0 and 1. In addition, the coordinate position of the second pixel P2 can be equal to the coordinate position of the first pixel P1 plus the motion vector MV, and the coordinate position of the intermediate pixel IP can be the middle point between the coordinate position of the first pixel P1 and the coordinate position of the second pixel P2. In an illustration, the determining unit 142 can set the luminance-adjusted factor $\alpha$ to be negatively correlative with the length of the motion vector MV. Therefore, when the length of the motion vector MV becomes bigger, the luminance-adjusted factor $\alpha$ generated by the luminance adjusting module 140 will approach closer and closer to 0, and when the length of the motion vector MV becomes smaller, the luminance-adjusted factor $\alpha$ generated by the luminance adjusting module 140 will approach closer and closer to 1.

In addition, the luminance adjusting unit 144 can be realized by a multiplier, and the luminance adjusting unit 144 can multiply the luminance of the intermediate pixel IP by the luminance-adjusted factor $\alpha$ to generate a luminance-adjusted pixel IP' in the luminance-adjusted image F'(n+0.5). For example, if IP=(Y, Cb, Cr), then IP'=(Y*$\alpha$, Cb, Cr), wherein Y is the luminance of the intermediate pixel IP, Cb and Cr are the chrominance of the intermediate pixel IP. Since the luminance-adjusted factor $\alpha$ is between 0 and 1, the luminance adjusting unit 144 is utilized to maintain or lower the luminance of the intermediate pixel IP to generate the luminance-adjusted pixel IP'.

Figure 3:
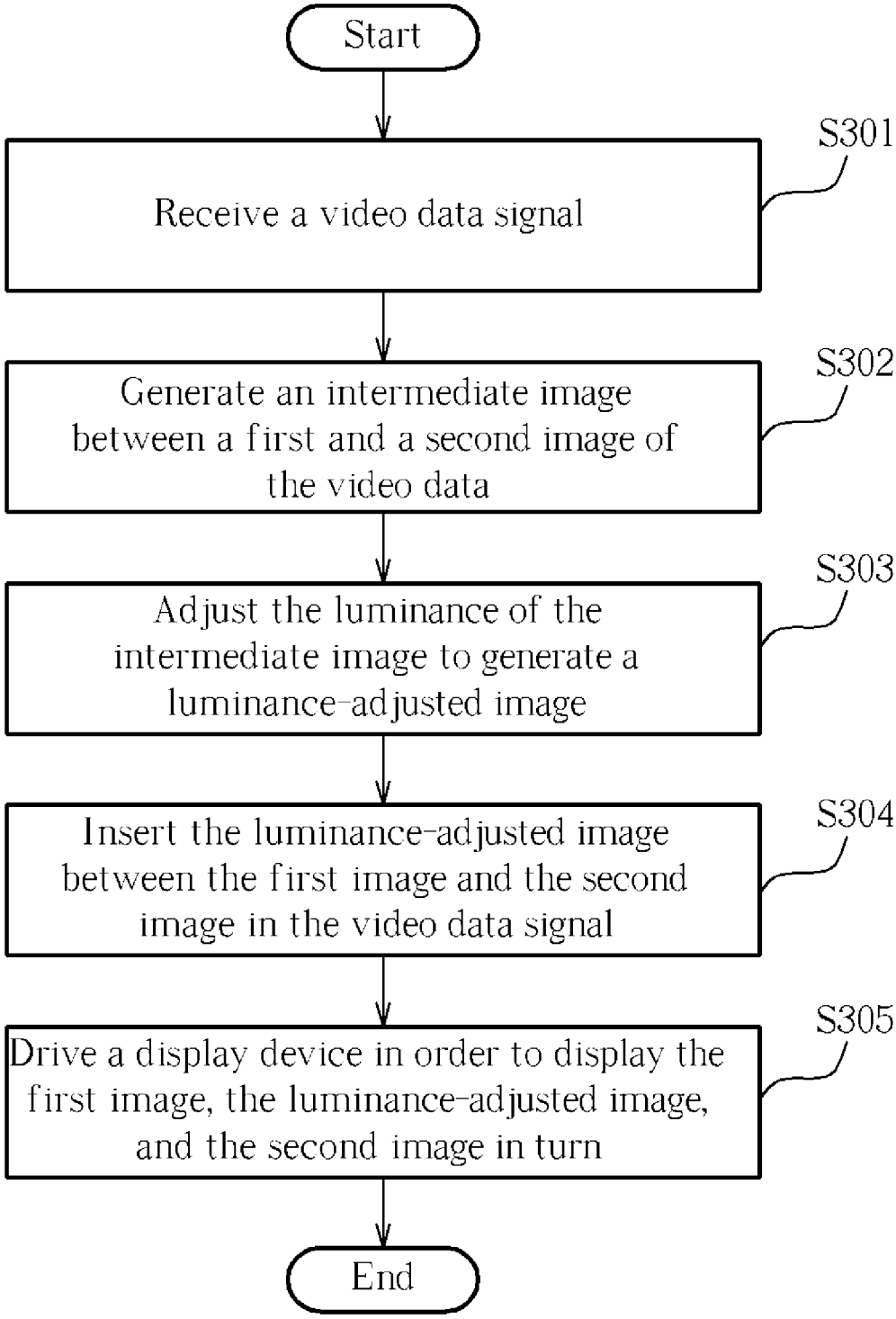
FIG. 3 is a flow chart of a video data processing and displaying method according to an embodiment of the present invention.

Please refer to FIG. 3. FIG. 3 is a flow chart of a video data processing and displaying method according to an embodiment of the present invention, for explaining the method provided by the present invention. The steps are as follows:

Step S301: Receive a video data signal. The method of the present invention performs very well, especially in the motion image data signal processing.

Step S302: Generate an intermediate image between a first and a second image of the video data, where the first image and the second image are adjacent to each other in the video data. The intermediate image can be generated by motion compensated interpolation according to contents of the first image and the second image.

Step S303: Adjust the luminance of the intermediate image to generate a luminance-adjusted image. The luminance-adjusted image is generated by adjusting luminance of a plurality of intermediate pixels of the intermediate image, and therefore the luminance of the luminance-adjusted image will be lower than the first image or the second image.

Step S304: Insert the luminance-adjusted image between the first image and the second image in the video data signal. After the luminance-adjusted image is inserted in the video data signal, the frame rate of the video data signal will be twice as fast as the original frame rate of the video data signal.

Step S305: Drive a display device in order to display the first image, the luminance-adjusted image, and the second image in turn.

Compared with the conventional black image insertion, the method in the embodiment can be called a "motion-adaptive image insertion and luminance adjustment". Each intermediate image F(n+0.5) can correspond to different $\alpha$ according to the motion level between image F(n) and image F(n+1). Additionally, the intermediate pixels IP with different positions in the intermediate image F(n+0.5) can also correspond to different $\alpha$. Therefore, the luminance-adjusted pixels IP' with different positions in the same luminance-adjusted image F'(n+0.5) are adjusted with different luminance. Since the luminance of the pixels in the inserted luminance-adjusted image has been lowered motion-adaptively, the display device can display the video data with quasi-impulse type effect. Thus, for the dynamic video data, the video data processing apparatus and the displaying and processing method of the embodiment can make the display device perform very well both in display capability and quality.

Please note that the display device mentioned in the embodiment can be a liquid crystal display (LCD), but this is not a limitation of the present invention. In fact, the display device mentioned in the embodiment can also be a plasma display or other type of display device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for displaying video data, comprising:

generating an intermediate image between a first and a second image of the video data, wherein the first image is adjacent to the second image in the video data;

lowering the luminance of a plurality of intermediate pixels of the intermediate image than luminance of pixels of the first and the second images to generate a luminance-adjusted image; and displaying the first image, the luminance-adjusted image, and the second image in turn;

wherein the step of generating the luminance-adjusted image comprises:

determining a luminance-adjusted factor for an intermediate pixel of the intermediate image according to a motion vector defined by a first pixel corresponding to the intermediate pixel in the first image and a second pixel corresponding to the intermediate pixel in the second image; and lowering the luminance of the intermediate pixel according to the luminance-adjusted factor in order to generate a luminance-adjusted pixel of the luminance-adjusted image.

2. The method of claim 1, wherein the step of generating the intermediate image comprises:

generating the intermediate image by interpolation according to contents of the first image and the second image.

3. The method of claim 1, wherein the step of determining the luminance-adjusted factor comprises:

determining the luminance-adjusted factor according to the length of the motion vector.

4. The method of claim 3, wherein the step of determining the luminance-adjusted factor according to the length of the motion vector comprises:

setting the luminance-adjusted factor to be negatively correlative with the length of the motion vector.

5. The method of claim 1, wherein the step of generating the luminance-adjusted pixel comprises:

multiplying the luminance of the intermediate pixel by the luminance-adjusted factor to generate the luminance of the luminance-adjusted pixel.

6. The method of claim 1, wherein the luminance-adjusted factor is between 0 and 1.

7. A video data processing apparatus, comprising:

an intermediate image generating module, for generating an intermediate image between a first and a second image of the video data, wherein the first image is adjacent to the second image in the video data;

a luminance adjusting module, coupled to the intermediate image generating module, for lowering the luminance of a plurality of intermediate pixels of the intermediate image than luminance of pixels of the first and the second images to generate a luminance-adjusted image; and a display driving module, coupled to the luminance adjusting module, for driving a display device in order to display the first image, the luminance-adjusted image, and the second image in turn;

wherein the luminance adjusting module comprises:

a determining unit, for determining a luminance-adjusted factor for an intermediate pixel of the intermediate image according to a motion vector defined by a first pixel corresponding to the intermediate pixel in the first image and a second pixel corresponding to the intermediate pixel in the second image; and a luminance adjusting unit, coupled to the intermediate image generating module, the determining unit, and the display driving module, for lowering the luminance of the intermediate pixel according to the luminance-adjusted factor in order to generate a luminance-adjusted pixel of the luminance-adjusted image.

8. The video data processing apparatus of claim 7, wherein the intermediate image generating module generates the intermediate image by interpolation according to contents of the first image and the second image.

9. The video data processing apparatus of claim 7, wherein the determining unit calculates the length of the motion vector, and determines the luminance-adjusted factor according to the length of the motion vector.

10. The video data processing apparatus of claim 9, wherein the determining unit sets the luminance-adjusted factor to be negatively correlative with the length of the motion vector.

11. The video data processing apparatus of claim 7, wherein the luminance adjusting unit is a multiplier, for multiplying the luminance of the intermediate pixel by the luminance-adjusted factor to generate the luminance of the luminance-adjusted pixel.

12. The video data processing apparatus of claim 7, wherein the luminance-adjusted factor is between 0 and 1.

13. The video data processing apparatus of claim 7, wherein the display device is a liquid crystal display (LCD).

14. A motion image data processing method, comprising:

receiving a motion image data signal;

generating an intermediate image according to two adjacent images in the motion image data signal;

adjusting luminance of each pixel of the intermediate image to generate a luminance-adjusted image and to let whole luminance of the luminance-adjusted image be lower than the adjacent images: and inserting the luminance-adjusted image between the adjacent images in the motion image data signal to generate an output data signal;

wherein the step of generating the luminance-adjusted image comprises:

determining a luminance-adjusted factor for an intermediate pixel of the intermediate image according to a motion vector defined by pixels corresponding to the intermediate pixel in the two adjacent images; and lowering the luminance of the intermediate pixel according to the luminance-adjusted factor.

15. The motion image data processing method of claim 14, wherein a frame rate of the output data signal is twice as fast as a frame rate of the motion image data signal.

16. The motion image data processing method of claim 14, wherein the intermediate image is generated by interpolation according to the adjacent images.

* * * * *